United States Patent [19]

Rippere

[11] 4,046,643

[45] Sept. 6, 1977

[54] PRODUCTION OF MULTI-METAL PARTICLES FOR POWDER METALLURGY ALLOYS

[76] Inventor: Ralph E. Rippere, 4145 Banff Lane, Phoenix, Ark. 85023

[21] Appl. No.: 611,810

[22] Filed: Sept. 9, 1975

[51] Int. Cl.[2] ..... C25D 5/18; C25D 7/00

[52] U.S. Cl. ..... 204/10; 204/23; 204/223

[58] Field of Search ..... 209/10, 23, 222, DIG. 8, DIG. 9, 209/223

[56] References Cited

U.S. PATENT DOCUMENTS

| | | | |
|---|---|---|---|
| 521,991 | 6/1894 | Sachs et al. | 204/10 |
| 1,986,197 | 1/1935 | Harshaw | 204/23 |
| 2,524,912 | 10/1950 | Jernstedt | 204/DIG. 9 |
| 2,651,609 | 9/1953 | Chester | 204/DIG. 9 |
| 2,678,909 | 5/1954 | Jernstedt | 204/DIG. 9 |
| 3,654,098 | 4/1972 | Backhurst | 204/222 |
| 3,703,446 | 11/1972 | Haycock et al. | 204/222 |
| 3,779,873 | 12/1873 | Dewar | 204/222 |

*Primary Examiner*—T. M. Tufariello

*Attorney, Agent, or Firm*—Finnegan, Henderson, Farabow & Garrett

[57] ABSTRACT

Methods for integrating alloy components into individual powder metallurgy particles, as opposed to the conventional side-by-side mixture of the separate powder particles of each individual component, are disclosed. Both simultaneous and sequential methods for consolidating electro-deposition particles are described. Additionally, electro-chemical displacement and chemical deposition methods are described for the production of binary component powders which can be used in conjunction with electro-deposition methods. As many as four different component metals and/or non-metals may be incorporated into consolidated powders for use in the powder metallury production of alloys.

24 Claims, 5 Drawing Figures

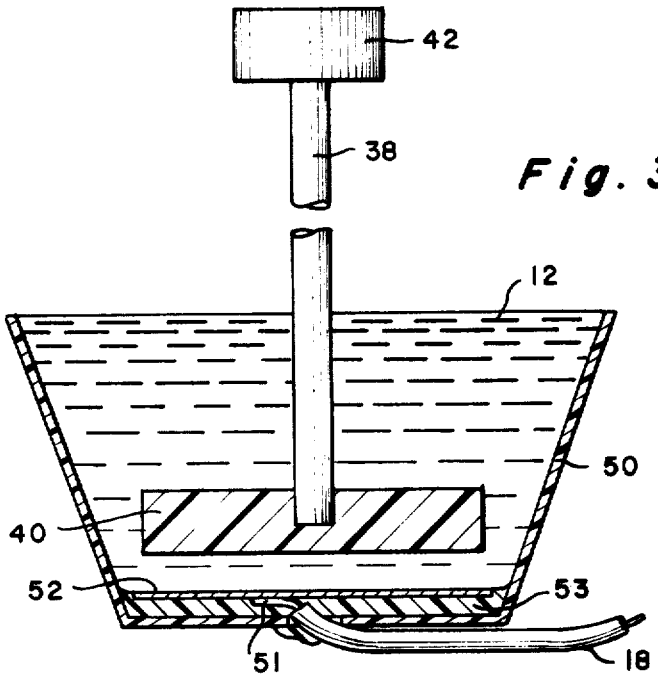
Fig. 3
Fig. 4
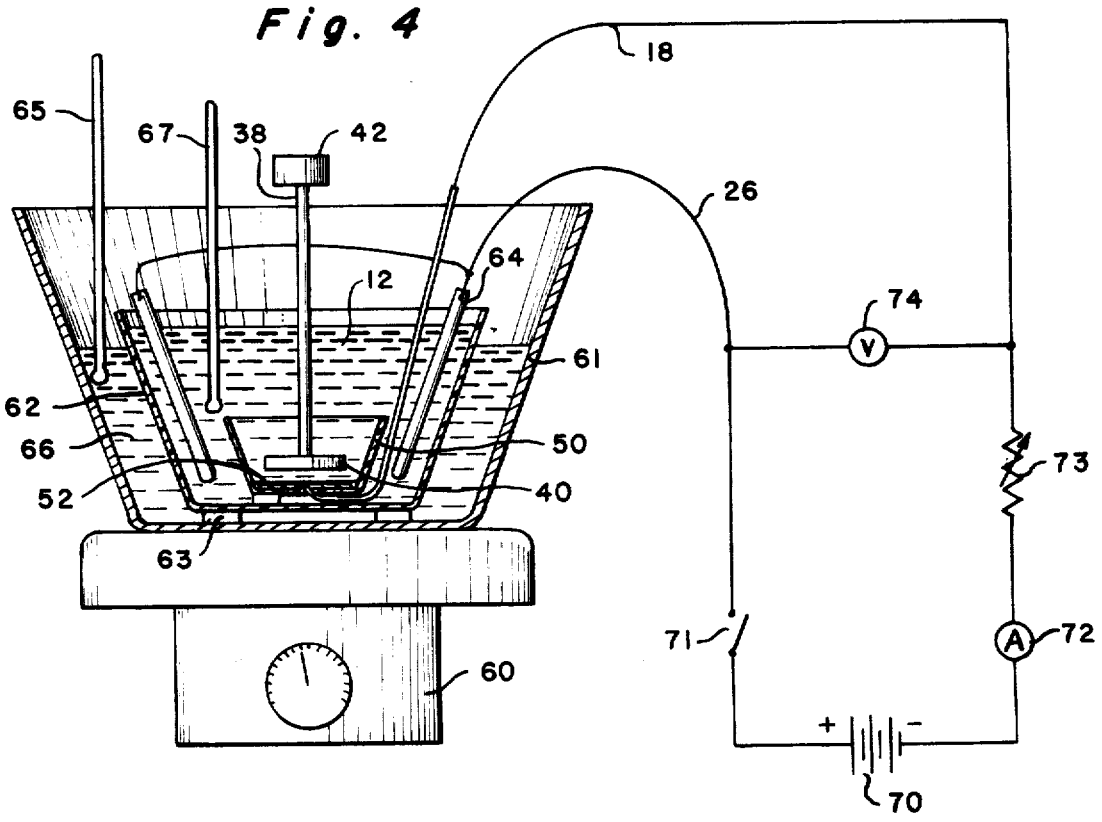

PRODUCTION OF MULTI-METAL PARTICLES FOR POWDER METALLURGY ALLOYS

BACKGROUND OF THE INVENTION

1. Field of the Invention

The present invention relates to the production of multi-metal powders by electro-deposition techniques.

2. Description of the Prior Art

An expanding area of technological innovation of diverse application is that of powder metallurgy. Metal compositions and forms can be obtained by pressure molding fine metal powders or mixtures of powders into a desired shape. The pressed object may then be heated, in an atmosphere which protects the metal against oxidation, at a temperature at which the crystals of the metal powder grains grow and regrow into each other across the powder grain boundaries without melting. In this fashion, the metallic crystalline equivalent of conventional production by casting and machining is produced. Powder metallurgy methods are especially favorable and desirable where one is concerned with conserving energy and materials as well as avoiding the waste and losses which attend the usual conventional melting, casting, rolling, and machining used to produce metal machinery components.

Powder metallurgy, in the past twenty-five years, has become an advanced science and has generated considerable amounts of applied technology. Metal powders with uniform chemical and physical characteristics are becoming available, making possible the production of high quality powder metallurgy products. The growth of the field is predicated upon basic economic and technological advantages which are inherent in powder metallurgy products and the processes for making them. This is particularly so when one considers the flexibility and versatility which is introduced in the integration of powder metal alloys.

Essentially, conventional powder metal products are formed by the compression molding of a suitable powder into a desired shape and then consolidating the same by a mild heat treatment. This type of production saves both direct machining costs as well as those indirect energy and waste losses normally associated with the salvage and reprocessing of machine shop and original foundry process scrap. In the present and future eras of intensifying shortages of energy and materials, these advantages of powder metallurgy methods are of fundamental importance to out economy and commerce.

Most conventional articles fabricated by powder metallurgy are multi-component or alloyed as opposed to a product comprised of a single metal component. This is because of the multitude of properties such as tensile strength, hardness, flexibility, etc., which are required for the performance characteristics of a variety of end products. Conventional powder metallurgy produced alloy articles are made from powders of the available alloy, or from an admixture of powders of the separate alloy components. Available methods for the reduction of an alloy to a powder, such as attrition or atomization, are not free of those factors which degrade the powder's chemical purity, especially that which exists at the surface.

Furthermore, these conventional methods do produce waste which is most often unsalvageable, and also consume excessive amounts of fuel. Moreover, the equipment is frequently complex and optimized to accommodate a particular material. Against this backdrop of prior art and attendant problems, applicant has developed various electrolytic methods for the production of high density copper powder as described in his co-pending Application Ser. No. 539,771, filed Jan. 9, 1975, now U.S. Pat. No. 3,994,785, issued Nov. 30, 1976. Therein copper powder of lower apparent density is used as a cathode for the formation of copper powder having a desired relatively high apparent density by means of an integral two-phase process.

The prior art is also aware of such processes as those described in U.S. Pat. No. 3,832,156 to Wilson et al which converts low green strength spherical metal powders to high green strength particles by physically changing the particle shape. In the Wilson et al patent the atomized powders are ball-milled nto flakes which are annealed above the recrystallization temperature in a non-oxidizing atmosphere. The resultant sintered cake is then mechanically disintegrated into irregularly shaped particles. Although related to the field of interest, this process is basically very different from applicant's invention which employs various electro-deposition techniques. Additionally, the Wilson et al process appears to be much more time consuming and difficult to control for an economic yield.

Also representative of the prior art is U.S. Pat. No. 3,838,982 which issued Oct. 11, 1974 to Sanderow et al, wherein the various powder metal particles are coated with a different metal having a melting temperature lower than that of the metal of the particles themselves. In Sanderow et al the coating metal fills the voids between the particles so that the object is impervious to fluids.

In view of this aforementioned technology, applicant has identified and examined the described problem areas, and extended his basic discoveries relating to the production of copper powder by electro-deposition into new methods of value for producing integral alloy powder metallurgy particles.

SUMMARY OF THE INVENTION

To achieve the foregoing objectives and in accordance with the purpose of the invention as embodied and broadly described herein, applicant has provided various new methods, generic and specific, for producing multi-metal powders by electro-deposition techniques. These methods are an extension of and improvement upon the basic electro-deposition techniques for producing powder metal particles as embodied in applicant's aforementioned U.S. Pat. No. 3,994,785.

Subsequent to the success achieved in applicant's aforementioned patent, the basic electrodeposition method was applied and extended to producing composite powder metal particles. These unobvious extensions of applicant's prior methods result in many advantages and improved properties for the production of powder metal products. One of the most significant improvements resides in the fact that particular, desired performance characteristics can be pre-selected and obtained in a precise, controlled manner. The processes and combinations described herein are designed to produce useful power metals in which as many as four different metals may be combined in each powder particle for utilization in conjunction with various electro-deposition methods to produce powder alloys.

Although the invention broadly and generically concerns itself with the application of one metal onto another, applicant has described four methods of producing the multimetal particle alloy powders. These four species methods are identified in this application as (1) simultaneous electro-deposition, (2) annular electro-deposition, (3) repetitive annular electro-deposition; and (4) direct alloy electro-deposition, respectively.

In the simultaneous electro-deposition method an apparent low density metal powder is plated in a solution of a second metal under conditions of reverse current. By reversing the current, during the plating process, a net overall effect of volume decrease is observed while the mass of metal powder increases. During this resultant densification a high degree of "diffusion" exists among the atoms of the two different metals.

Annular electro-deposition described a process whereby the substrate or "core" particle has a compact internal condition. Accordingly, the second metal deposits itself annularly about the central core with relatively little penetration and/or diffusion of the atoms of the two different metals.

The repetitive annular electro-deposition method involves an extension of the second method described above wherein alternate powder metal layers are annularly deposited about a compact internal "core," thereby creating multiple layer zones and greater diffusion of the metal atoms.

In the direct alloy electro-deposition method, a plurality of metals are simultaneously deposited onto a central core. Such a method is useful, for example, in the context of a binary plating alloy solution wherein an initiating powder has not yet been attained.

In the broadest sense, applicant's invention resides in a method of producing a unitary composition of multi-metal particles comprising the steps of providing a cathode comprising of powder of at least a first metal; electro-depositing particles of a second metal onto said cathode from an electrolytic composition containing ions of said second metal; and continuing the electro-deposition of said particles until a desired multi-metal composition is obtained.

In a more narrow sense, applicant's invention describes a method of producing a diffuse composition of multi-metal particles comprising the steps of providing a cathode comprising a relatively low apparent density powder of at least a first metal; electro-depositing particles of a second metal onto said cathode from an electrolytic composition containing ions of said second metal; continuing the electro-deposition of said particles until a desired substantially homogeneous multi-metal composition is obtained.

Applicant's invention further described a method of producing an integral composition of multi-metal particles comprising the steps of providing a cathode comprising a relatively high density powder of at least a first metal; electro-depositing particles of at least a second metal onto said cathode from an electrolytic composition containing ions of said second metal; and continuing the electro-deposition of said particles until a desired multi-metal composition is obtained wherein the deposited metal forms a discrete, substantially laminar layer superimposed upon the relatively high apparent density cathodic powder base.

Another aspect of applicants invention describes a method of producing a unitary composition of multi-metal particles comprising the steps of providing a cathode comprising a powder of at least a first metal; electro-depositing particles of at least a second metal onto said cathode from a first electrolytic composition containing ions of said second metal; continuing the electro-deposition of said second metal particles until a discrete substantially laminar layer of said second metal particles is superimposed upon the cathodic powder, thereby forming a first laminate base; electro-depositing particles from a second electrolytic composition containing ions of at least one metal different from said second metal upon said first laminate base; and continuing the electro-deposition of said different metal particles until further discrete substantially laminar layer of said different metal particles is superimposed upon said first laminate base.

Finally, applicant's invention in a more defined sense relates to a method of producing a unitary composition of multi-metal particles comprising the steps of providing a cathode comprising a powder of at least a first metal; electro-depositing particles of a plurality of metals onto said cathode from an electrolytic composition containing ions of a plurality of metals; and continuing the electro-deposition of said particles until a desired multi-metal composition is obtained.

BRIEF DESCRIPTION OF THE DRAWINGS

The invention resides in the novel processes, steps, combinations, arrangements, constructions, and improvements shown and described. The accompanying drawings, which are incorporated in and constitute a part of this specification illustrate preferred embodiments of the invention, and together with the general description of the invention above and detailed description of preferred embodiments given below, serve to explain the principles of the invention.

FIG. 3 shows an elevational view in partial cross-section of the cell structure used in the initial phase and/or phases required to prepare the depositing metal powder for subsequent deposition onto independent cathodic metal powder particles. This structure refers specifically to that which is used in conjunction with the composite metal procedures employed in Examples 7 and 8 herein.

FIG. 4 shows schematically and in partial cross-section a view of an assembly to include the overall electrical circuitry and hot plate for use in connection with the final phase of Examples 7 and 8 wherein powdered copper and nickel respectively are deposited onto the cathodic metal powder particles employed therein.

Figure 1:
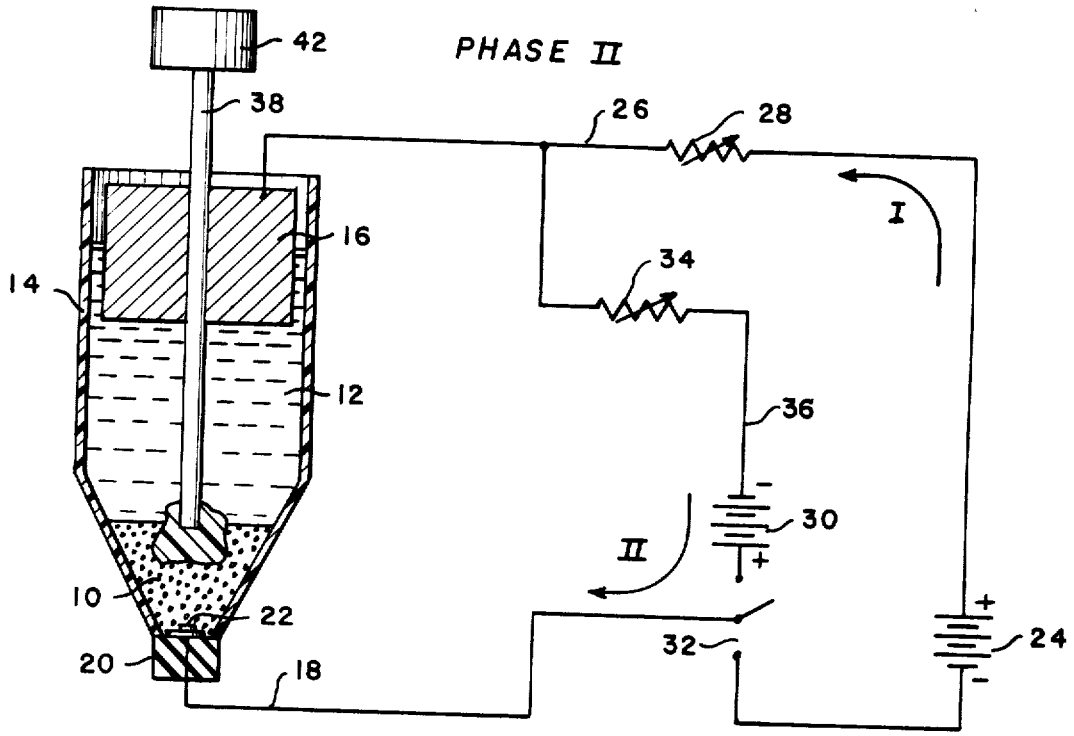
FIG. 1 schematically and in partial cross-section shows the cell assembly and electrical circuiting for Phase 2 operations wherein the powder from Phase 1 becomes the cathode upon which other metal powder and/or powders are electro-deposited.

The above general description and the following detailed description are merely illustrative of the generic invention, and additional modes, advantages, and particulars of this invention will be readily suggested to those skilled in the art without departing from the scope of the spirit of the invention.

DETAILED DESCRIPTION OF THE INVENTION

To represent the generic concept and scope embraced by the disclosed invention, applicant has selected as illustrative, and by no means limiting, four (4) methods of producing the desired multi-metal particle alloys. These integrated multi-metal powders are produced by various processes which improve upon the basic electrolytic methods used in the production of high density copper powder as disclosed in applicant's co-pending U.S. Patent Application No. 539,771, filed Jan. 9, 1975, now U.S. Pat. No. 3,994,785, issued Nov. 30, 1976 which is herein incorporated by reference. Although related in generic concept, each of these four representative multi-metal powder "builds" is distinctly different and affords specific and unique advantages.

The four representative processes described herein for the production of integrated multi-metal powders are referred to respectively as:

Process 1: Simultaneous Electro-deposition
Process II: Annular Electro-deposition
Process III: Repetitive Annular Electro-deposition
Process IV: Direct Alloy Electro-deposition.

These four processes will be described in more detail below with the benefit of representative exemplification.

Applicant's invention resides in the general inventive concept as embodied in the disclosed electro-deposition methods. Accordingly, applicant's invention contemplates the use of numerous electrolytic solutions and cathodes which incorporate various metal formulations.

Representative of those metals which can be utilized according to applicant's invention are the following: iron, nickel, copper, tin, zinc, lead, chromium, gold, silver, platinum, irridium, rhodium, ruthenium, cobalt, indium, manganese, antimony, cadmium, and combinations thereof.

While the above metal listing is representative, applicant's invention particularly prefers the use of the following metals as comprising its electrolytic solutions and/or cathode content: iron, nickel, copper, tin, zinc, lead, chormium, and combinations thereof.

All of the above listed metals can be plated out of aqueous solutions, hence their use does not involve elaborate equipment other than that described in the illustrative examples.

Specific combinations will be determined by the desired end product alloy. For example, copper and silver in different ratios could be used to develop desired coin silver and/or sterling silver powder metallurgy fabrications.

Throughout this specification, terms such as "relatively low" and "relatively high" apparent density are employed.

Powder densities are always less than maximum theoretical density (T.D.) because of the resultant void space inherent in non-worked powder metallurgy products. Assuming prefect spherical particle formation, the ultimate apparent density is 65% of T.D., because of the 35% void space.

In any powder metallurgy production scheme, however, there are deviations from true spherical particle formations. Accordingly, the apparent densities are usually considerably less than the ultimate 65% of T.D.

As employed in this invention the term relatively high apparent density is intended generally to mean those densities which exceed 33% of T.D., and the term relatively low apparent density is intended to means those densities which are generally less than 22% of T.D.

Using pure copper, which has a T.D. of 8.9 g/cc., as an example, the relatively high apparent density line of demarcation would be approximately 3.0 g/cc. and the relatively low apparent density line of demarcation would be approximately 2.0 g/cc. Similar apparent density figures can be obtained for any other selected powder metal formulation.

Although the specification describes four representative processes for the production of integrated multi-metal powder products, there are basically two kinds of products that can be developed. These products are made by the electroplating or electro-deposition of one metal onto the finely powdered form of another.

The first kind (Type 1) of product is obtained by direct plating onto a dense, compact or nodular base, and obtaining an annular structure. In this product form, a central core of the first metal is covered by a discrete layer of the plated-on second metal. The utility of this Type 1 product is represented by the following copper on iron illustration.

Copper in relatively small amounts exerts a favorable influence upon the dimensional stability of a powder metallurgy iron compact which is being sintered. Thus an annular copper upon iron deposition would develop an alloy powder which does not segregate due to inherent differences in structure and density of the two components of a physical mixture. Moreover, the iron powder is protected against atmospheric deterioration by the outer covering of copper. The resultant annular powder would be more stable than conventional two-powder mixes in storage.

The second kind (Type 2) of product developed is that which is obtained by simultaneously electrically densifying the first metal (starting in a low apparent density form) via repetitive plating and deplating in the salt solution of the second metal. This method results in the simultaneous deposition of the two metals yielding a central core of a homogeneous two metal alloy. As this densification progresses, the binary composition changes to yield a richer outer zone but not a distinct and discrete interfacially defined outer layer as is the case with the first product type.

Representative of the second product types (Type 2) described above are those multi-metal powders developed according to Process I.

Process I: Simultaneous Electro-deposition

According to this process, an apparent low density metal powder is plated in a solution of a second metal under conditions of some reverse current, as by periodic reverse current or periodically imposed alternating current.

Phase I: Production of the Starting Powder Metal Particles

Figure 2:
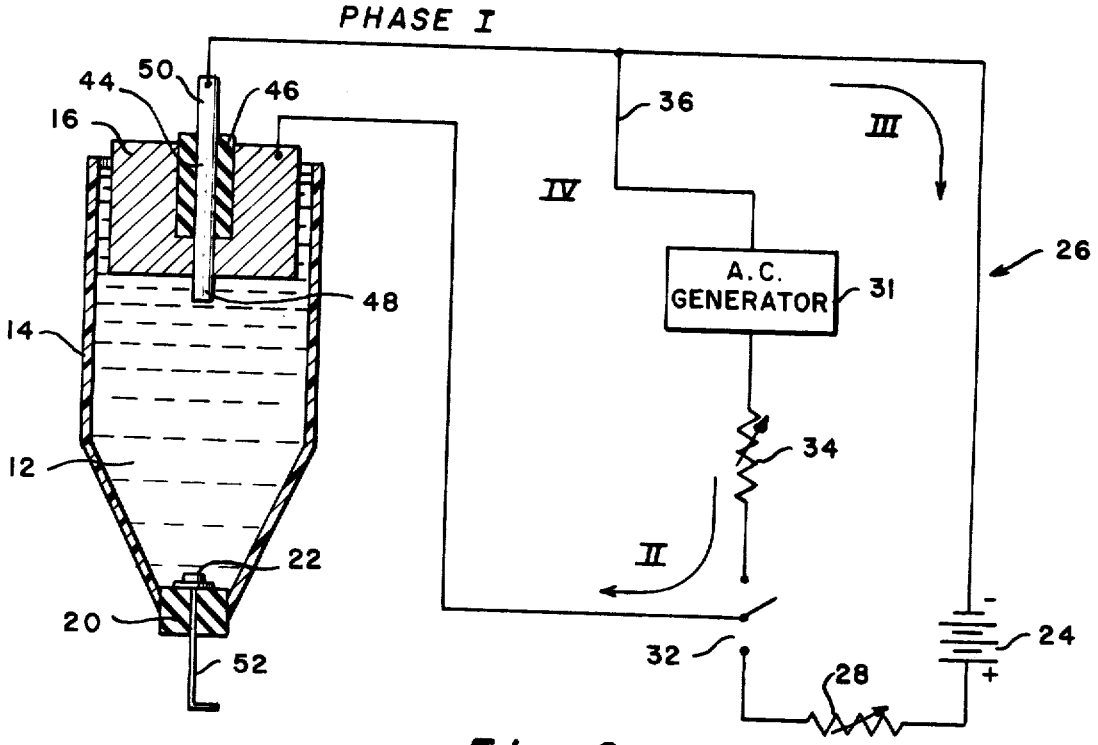
FIG. 2 shows schematically and in partial cross-section a view of an assembly to include the overall electrical circuiting for Phase 1 or the initial plating operation for the production of the starting powder metal particles.

Phase I of this process relates to the production of a base metal powder of low apparent density. FIG. 2 illustrates the apparatus in which the lower apparent density metal powder, useful as a cathode in the Phase II deposition, can be produced. One of the advantages of producing relatively low apparent density metal powder according to the methods described herein is that essentially the same apparatus can be used in the Phase II overplating process.

Because both the FIG. 1 and FIG. 2 schematics, attendant apparati and reference numerals parallel those used in applicant's aforementioned U.S. Pat. No. 3,994,785, reference can be made thereto for equivalent and/or parallel structure. Accordingly, the specific structure described and employed herein is representative only to that which may be used to practice applicant's processes and is in no way intended to limit applicant's invention.

Referring to FIG. 2, an electrolytic cell 14 is provided with electrodes, and as embodied in and shown in FIG. 2, the electrodes comprise conductors 16 and 44. Conventional conductor 16 functions primarily as the anode. However, it may function as a cathode by reversal of current flow.

Conductor 44 is a metal rod, preferably of copper, having a sleeve 46 of an insulating material, e.g. a rubber tubing, which limits the active area of conductor 44 to lower rod portion 48 immersed in electrolyte composition 12. The upper rod portion 50 is out of contact with the electrolytic composition 12.

Conductor 44 functions primarily as a cathode during electro-deposition, although by reversal of current flow, it can operate as an anode.

The bottom portion of cell 14 is closed by insulated plug 20 through which extends wire 52 culminating in contact 22. Wire 52 does not participate in the electrodeposition process and the electrolytic cell 14 can be closed by any suitable means. However, the use of wire 52 culminating in contact 22 and plug 20 enables the system to be readily converted wherein wire 52 becomes conductor 18 as shown in FIG. 1 when in communication with a source of electric current.

Conductor 16 and 44 are in communication with a source of electric current. In the embodiment illustrated in FIG. 2, the primary source of current for electrodeposition is shown schematically as direct current battery 24, which comprises the source of power for circuit III. When in operation circuit III effects electrodeposition of metal from the solution 12, cylinder 16 functioning as the anode and lower portion 48 of rod 44 functioning as the cathode.

Circuit III may also employ a current regulating means, such as variable resistor 28 shown in FIG. 2 which permits variation and control of the current introduced into the electrolytic cell 14.

In the system for generating low apparent density powder, there is provided means for interrupting the electro-deposition process. As shown in FIG. 2, interruption is accomplished by employing a source of alternating current which introduces a period of current flow reverse to that created by battery 24, said source shown as A.C. Generator 31, and comprising the source of power for circuit IV.

Circuits III and IV are alternative, and means for selecting the desired circuit is provided in the form of switch mechanism 32. Preferably, a variable resistance means such as variable resistor 34 is used in conjunction with A.C. Generator 31. Conventional conductors 26 and 36 connect sources of power 24 and 31 respectively to conductors 16 and 44.

A.C. Generator 31 may for example be a 60 cycle 115 volt A.C. Generator, and preferably means are provided to vary the A.C. output, such as providing an auto transformer, e.g., as marketed under the name "Variac".

Modifications to the described circuitry, such as the placement of ammeters and voltmeters to measure current and potential differences respectively, will be apparent to those skilled in the art.

It is noted that the cell employed in Phase I centers around the cathode. With a cylindrical cathode such as that shown, chosen for the greater uniformity of current distribution, doubling the diameter quadruples the cross-section area thereby reducing the internal resistance per unit length by a factor of 4. Therefore the cathode can be increased fourfold for the same internal resistance. Accordingly, the changes in area, current density, and internal voltage drop are subject to similar elementary treatments.

It is also noted that the cone bottom of the first phase cell 14 is used to confine the powder for the initial plating of the second phase, to eliminate the need to transfer a bulky powder to another cell. As will be obvious to one skilled in the art, the particular cone angle and relative truncation depth is, in part, determination of the particle size distribution.

In Phase I operation, metal from the electrolytic solution 12 is plated on cathode 44 during the electrodepositon process effected through operation of circuit III. Current flows from the positive terminal battery 24 through variable resistor 28 adjusted to introduce the desired current into the electrolytic cell 14. A current then passes through electrolytic solution 12 causing plating of the metal from the solution onto the cathode 44. The current then returns through conductor 26 back to the negative pole of battery 24.

The current voltage and duration of plating are suitably selected to achieve a relatively low apparent density metal powder which is easily removed from the cathode, for example, by a simple hammer blow upon the end of the cathode or by a vibration from a 60 cycle electrical vibrator.

After the low apparent density powder is generated and collected in Phase I, it is subsequently used as the cathode for metal deposition according to Phase II described below.

Phase II: Overplating of Second Metal onto the First Metal Powder Produced During Phase I The general schematic and attendant apparati employed in the various Phase II processes described in this application are shown in FIG. 1. The electrolytic cell 14 comprises a container having a sloped bottom. The design of the cell for Phase II deposition is dependent upon the following factors; obtaining the requisite turnover of the powder for uniformity of product, regulation of the area current density which in turn is dependent upon the available current, and the quantity of the powder to be deposited. A 60° cone angle is normally used where the quantity of powder is relatively small. On the other hand, a flat tublike electrolytic cell with steep walls and a large, whole bottom contact has the advantage of almost uniform area, which is significant as the powder volume increases. In the second stage of Phase II plating, the current density per geometric area is not critical to the powder particle formation, only to its rate of growth.

The cone bottom plating cells return all suspension to the cathode at the bottom of the cone. Accordingly, the walls must initially be very steep, to slide the settled out powder to the bottom of the cell. As the density increases from less than 1.0 to 1.5 or 2.0 grams/c.c., the minimum necessary angle or repose decreases. The particular electrolytic cell shape depends also upon the quantity of powder available. As the quantity increases a larger exposed area is necessary to obtain a more thorough mixing or turnover of the powder.

In accordance with the general Phase II process, the electrolytic cell 14 is provided with an electrode in addition to the metallic powder 10 generated in Phase I. This electrode comprises conductor 16 which is preferably shown as a metal cylinder suspended by means (not shown) in the electrolytic solution 12.

The metal cylinder 16 is preferably of copper although it is within this invention to use other means, representative examples of which are set forth in the specific process examples described later in the specification.

Conductor 16 functions primarily as the anode. However, it may function as a cathode by reversal of the current flow.

In keeping with the invention concept, there is provided electrical contact to the metal powder 10. Conductor 18 provides such electrical contact and it comprises a thin metal wire preferably of copper and suitably protected by an insulating sheath, i.e., ordinary copper electrical wire. Conductor 18 extends through insulating plug 20 and culminates in contact point 22 at the bottom of cell 14 in the solution 12. Contact 22 may be, for example, a flat spiral of number 16 gauge copper wire and the insulating plug 20 may be an ordinary rubber stopper.

Conductors 16 and 18 are in communication with a source of electric current. The primary source of current for electro-deposition is shown schematically as direct current battery 24, which comprises the source of power for circuit I. When in operation, circuit I effects electro-deposition of metal from solution 12 with cylinder 16 functioning as the anode and metal powder 10 functioning as the cathode upon which the solution metal is deposited.

The copper cylinder 16 communicates with battery 24 through a conventional electrical conductor 26. Although not necessary to the electro-deposition process, it is preferred to employ a current regulating means, shown and embodied in FIG. 1 as variable resistor 28 which permits variation and control of the current introduced into the electrolytic cell 14.

There is also provided a means for interrupting the electro-deposition process. This interruption is facilitated by employing a source of direct current having a direction of flow reversed to that created by battery 24, said source shown as battery 30, comprising the source of power for circuit II. Circuits I and II are alternative. Accordingly, for a period of time circuit I is in operation causing plating or deposition, while for a different period of time, interruption circuit II is in operation causing some deplating as further explained below.

As similarly provided in FIG. 2, the Phase II (FIG. 1) general schematic includes a means for selecting the desired circuit. Such means comprises switch mechanism 32. Preferably, a variable resistance means shown in FIG. 1 as variable resistor 34 is used in conjunction with battery 30, connected thereto by conductor 36 which may be ordinary electrical wire. Battery 30 and variable resistor 34 may be the same as battery 24 and variable resistor 28. Instead of a source of reverse direct current such as battery 30, a source of alternating current such as a 60-cycle, 115 volt A.C. generator, may be used to effect interruption of the electro-deposition process. As previously referred to in the Phase I (FIG. 2) schematic, means may be provided to vary the A.C. output by using conventional commercial auto transformers.

Any suitable switch mechanism may be used as means for electrically connecting electrodes 16 and 10 with either circuit I or circuit II. It is preferred to provide means for timed switching from one circuit to the other. Accordingly, any appropriate and conventional switch mechanism can be set to periodically switch over from the primary circuit I to interrupting circuit II according to predetermined schedule, and which preferably permits modification of the schedule as desired.

There is also provided a means for agitating the metal powder 10 and electrolytic solution 12. The FIG. 1 schematic shows a stirring device 38 having a blade 40 immersed in both the electrolytic solution 12 and the metal powder 10. This stirring device is driven by a motor shown generally at 42.

Without intending to be bound by any theory of operation, it is believed that the metal powder 10 of relatively low apparent density produced according to the phase I process, functions as a cathode upon which other metal powders from the electrolytic solution 12 are deposited to increase the apparent density of the newly formed multi-metal powder.

Circuit I is used to effect electro-deposition. Current flows from the positive terminal of battery 24, through variable resistor 28 adjusted to introduce the desired current into the electrolytic cell 14, and to open cylinder copper anode 16 which is suspended in cell 14. The current then passes through electrolytic solution 12 causing plating of metal from the electrolytic solution onto the metal powder 10. The current then passes to electrode 22 and finally through conductor 18 back to the negative pole of battery 24.

In practice, the current, voltage and duration of plating are suitably selected to achieve the desired apparent density. The current density is the current in amperes per square inch of the geometric area of the boundary of the zone in which the metal powder is located. The preferred paramteres of operation are specifically set forth in the representative process examples described below.

It has been found that interruption of the electro-deposition contributes to the production of high apparent density powder. The interruption is preferably effected by imposing reverse direct current on the system, as by using circuit II shown in FIG. 1. It may also be achieved by imposing alternating current.

During the period of interruption, some deplating occurs caused by the reverse direct current or alternating current. This deplating has been found to improve the surface of the deposited particles, cause compaction, and to improve the density.

The electrolytic solution is preferably agitated in the area of the low apparent density metal powder during electro-deposition. Thus, the powder 10 would be continuously agitated by rotating blade 40 of stirrer 38. This agitation has been found to lead to better results, including higher efficiency and a higher apparent density product. Preferred agitation rates are set forth in the expemplary specifications described below.

Although these process examples refer to relatively small quantities of materials, repeated depositions employing different quantities according to the described process parameters have generated consistent results. Accordingly, the described process parameters can be extrpolated from experimental to commercial scale by simply applying the appropriate mathematical formulations such as Ohm's law with respect to the necessary electrical circuit requirements for the primary power supply, circuit conductor resistances, variable resistances, and the cell geometry respectively.

Referring specifically to the Phase II operation of Process I, at the initiation of the plating during the circuit I mode, a second metal from electrolytic solution 12 deposits itself onto the low density, dendritic or highly branched thin crystals of the first metal powder produced during Phase I. These first metal particles therefore become coated with the second metal particles.

During the next interval, the circuit II reverse current mode, metal is deplated from the high spots of the powder. In this deplating, both metals are removed from the solid and the electrolyte becomes a binary metal solution adjacent to the powder particles. Subsequently, during the return to the circuit I mode, the plating takes place from a layer of solution containing both the ions of the first and second metals, and the deposition is then that of both metals.

The process during the mode I circuit "builds" on all of the surfaces. The process in the reverse circuit II mode causes removal from the "higher spots" which amounts to a short duration electrosmoothing.

Accordingly, the net effect observed is a decrease in overall volume, while the mass of metal powder is increased. The incremental differential plating density, e.g., (volume change,/weight change) amounts to a true densification, wherein there is a volume decrease together with a simultaneous increase in the total mass of deposited powder. This result implies a high degree of diffusion between and among the atoms of the two different metals. One advantage from such a structure is the decreased time required for concentration leveling to occur by diffusion in attaining to a homogeneous alloy.

Examples 1 and 2 set forth below are representative of those Type 2 products that can be obtained via Process I (e.g., the simultaneous electro-deposition method). In Example 1 nickel is electro-deposited onto low density copper and in Example 2 zinc is electro-deposited onto low density copper.

EXAMPLE I

This example shows how a second metal was electrodeposited onto a low-density powder of a first metal with increase in weight and simultaneous decrease in volume, to produce a composite powder of greater apparent density.

| Phase I. Production of base powder of low apparent density powdered copper. | | | |
|---|---|---|---|
| Apparatus: | See FIG. 2 | | |
| Solution: | $Cu\ SO_4 . 5H_2O$ | 142 g/l | Volume 600 ml |
| | $Cu++$ | 37 g/l | |
| | $H_2SO_4$ | 87 g/l | |
| | $H+$ | 1.70 N | |
| Temperature: | 35° C | | |
| Cathode: | 1.66 square inches of area as a solid rod, 2.6 inches long by 0.20 inches diameter. Vertical position. | | |
| Anode: | 4 inches by 6 inches, open cylinder, 4 inches tall, copper | | |
| Inter-electrode Distance: | 1 inch | | |
| Stirring: | None | | |
| Timing: | Cycle of 15 seconds: | | |
| | Direct Current | | 10 seconds |
| | Alternating Current | | 5 seconds |
| Direct Current: | 3.0 Amperes, 2.0 Volts to first cathode clearing | | |
| | 6.0 Amperes, 2.8 Volts through successive cathode clearings | | |
| Alternating Current (60 cycle): | 1.5 Amperes to first cathode clearing | | |
| | 2.5 Amperes through successive clearings | | |
| Deposition Times: | To first cathode clearing | | 10 minutes |
| | To successive cathode clearings | | 20, 20, 10 minutes |
| Cathode Clearing: | By vibration from a 60 cycle vibration engraving tool, pressed to top of cathode bar. | | |
| Anode Weight Change: | 4.1 grams | | |
| Powder Product: | Wet - 7 ml | | |
| Apparent Density: | Wet - 0.67 g/ml $\frac{47.2\ g}{70\ ml}$ | | (Previous parallel production) |
| PHASE II. Overplating of nickel onto the copper powder Produced in Phase I. | | | |
| Apparatus: | FIG. 1. | | |
| Solution: | $Ni\ Cl_2 . 6H_2O$ | 300 g/l | Volume 500 ml |
| | $H_3\ BO_3$ | 30 g/l | |
| Solution Change: | By decantation of copper solution; addition, stirring and decantation of nickel solution repeated three times. Powder always wet by plating solution. | | |
| Temperature: | 34 - 35° C | | |
| Cathode: | Powder produced in Phase I. 3 cm diameter upper surface in 60° cone. | | |
| Anode: | Pure nickel sheet, 2 each 1 inch × 3 inches. | | |
| Interelectrode Distance: | Approximately 1 inch from bottom of vertical anode to top of powder cathode. | | |
| Stirring: | 4 to 5 r.p.m. paddle in powder. | | |
| Timing: | Cycle - 60 seconds: | | Forward, 49 seconds Reverse, 11 seconds |
| Forward Current: | 1.2 to 1.4 Amperes | 3.1 to 3.4 Volts | - initial 2 hours |
| | 0.3 Amperes | 1.0 Volts | - next 2 hours |

-continued

| | | | |
|---|---|---|---|
| Reverse Current: | 0.8 Amperes | 2.3 Volts | - next 3½ hours |
| | 1.8 Amperes | 2.8 Volts | - initial 2 hours |
| | 0.4 Amperes | 1.0 Volts | - next 2 hours |
| | 1.2 Amperes | 2.3 Volts | - next 3½ hours |
| Volumes, Wet | | Initial | 7.0 ml |
| | | After first 2 hours | 6.5 ml |
| | | After next 2 hours | 6.0 ml |
| | | After next 3½ hours | 6.3 ml |
| Anode Weight Change: | | 5.75 g | |
| Powder Product Work Up: | | Rinse with water 3 times | |
| | | Rinse with alcohol 3 times | |
| | | Vacuum oven dry | |
| | | Sieve | |

Sieve Characterization:

| Mesh | | ml | %Vol*. | Grams | % Wt. | Apparent Density |
|---|---|---|---|---|---|---|
| | −35 | 0 | 0 | 0 | 0 | — |
| −35 | +60 | 0.70 | 15 | 1.34 | 14.2 | 1.91 |
| 60 | +200 | 2.80 | 62 | 5.30 | 56.4 | 1.89 |
| −200 | +325 | 1.20 | 27 | 2.05 | 21.9 | 1.71 |
| −325 | | 0.40 | 9 | 0.69 | 7.3 | 1.72 |
| Total: | | | 113 | 9.38 | 99.8 | |
| Composite: | | 4.50 | | | | 2.08 |

Previous Parallel Production
Sieve Characterization:

| Mesh | | ml | % Vol*. | Grams | % Wt. | Apparent Density |
|---|---|---|---|---|---|---|
| | −60 | 0 | 0 | 0 | 0 | — |
| −60 | +200 | 3.2 | 50 | 4.05 | 44.4 | 1.26 |
| −200 | +325 | 2.0 | 31 | 2.43 | 26.0 | 1.22 |
| −325 | | 2.4 | 37 | 2.85 | 30.5 | 1.19 |
| Total: | | 7.6 | 118 | 9.33 | 100.9 | — |
| Composite: | | 6.4 | | | | 1.46 |

$$*\% \text{ Vol.} = \frac{\text{fraction volume}}{\text{composite volume}} \times 100$$

| Phase II Powder: | | Analysis** | Calculated*** |
|---|---|---|---|
| | Copper | 32% | 42% |
| | Nickel | 63% | 58% |

**By commercial laboratory, by Atomic Absorption Spectroscopy.
***From raw anode weight changes.

DISCUSSION OF EXAMPLE I

The principle involved in Example 1 recognizes the extensive re-organization of the crystals of the first metal via dissolution or de-plating at the "high spots" or those closest to the anode during the reverse plating stage of the cycle and re-deposition during the forward plating stage of the cycle.

Because metal number one is in a solution of metal number two there exists co-mingling of the ions of both metals in the solution as a result of the reverse (deplating) stage and some co-deposition of both metals during the forward (deposition) stage. The forward deposition stage is of greater ampere seconds duration than the reverse ampere seconds. The amperes need not be equal.

In Example 1, as the electro-deposition procedes the surface becomes richer in metal number two, hence the proportion of metal number one deplating into the solution decreases as the process carried on. Thus there exists a transition zone in the solid in which there is a gradual change of concentration of metal number one from 100% to almost 0% and a reciprocal change in metal number two. This transition zone is equivalent to a thermally induced inter-diffusion of the two metals from a common interface into each other. Therefore, the Example 1 electro-deposition generates a two metal alloy wherein the two metal atoms are intermixed without the application of heat.

EXAMPLE 2

Here the combination of metals was selected to show the applicability of the invention to the preparation of integral composite metal powders useful to the commerce of brasses by powder metallurgy. While brass is a soft alloy and can be converted into a coarse powder to employ the benefits of powder metallurgy, foundry wastes in fluxes, flue dusts, sprues and spatter are unavoidable. the electro depositions of this example and of the base copper powder are free of corresponding losses. An additional economic advantage is obtained when one considers providing powders for a range of brasses. Only two solutions and two kinds of anodes are really necessary beyond the one basic cell, and production need only keep up with current requirements. No inventory of excess production, because of convenient melt sizes, is necessary.

This example of integral binary metal powder production was conducted in two phases, similar to Example 1.

| Phase I. Production of a Base Powder of Low Apparent Density Copper Powder | |
|---|---|
| Apparatus: | The plating cell and electrical supply were those of Example 1., Phase 1. |
| Solution: | The same as Example 1., Phase I. |
| Temperature: | 35° C. |
| Cathode: | Copper rod 2.6 inches long by 0.20 inches diameter. 1.66 square inches of area. |
| Anode: | Sheet copper 4 inches by 6 inches, open cylinder, 4 inches tall. |
| Cathode/Anode Distance: | Approximately 1 inch. |
| Stirring: | None |
| Timing: | Cycle of 15 seconds, repeated. Direct Current, 10 seconds. Alternating current 5 seconds. |
| Deposition: | 1 hour<br>D.C. 5.4 to 4.8 amperes at 2.8 volts.<br>A.C. 2.3 amperes at 0.5 volts. |
| Cathode Clearing: | Every 15 minutes, a vibratory engraving tool operating on 60 cycle A.C. was pressed to the top of the cathode and the deposit vibrated loose. |

-continued

| | |
|---|---|
| Anode Weight Change: | 4.8 grams. |

Phase II. Overplating of Zinc onto the Copper Powder Produced in Phase I, by Periodic Reversed Direct Current.

| | |
|---|---|
| Apparatus: | As in Example 1., Phase II. |
| Solution: | $ZnSO_4 . 7H_2O$ 352 g/liter<br>$(NH_4)_2SO_4$ 30 g/liter<br>pH 3.0 to 3.5<br>pH adjusted by $H_2SO_4$ |
| Solution Change: | The powder was always kept wet by plating solutions. The solution was changed by decantation, flooding, stirring and decantation, repeated three times. |
| Temperature: | 20° C to 35° C. |
| Cathode: | The powder obtained in Phase I. from copper anode weight loss of 4.8 grams. |
| Anode: | Zinc strips 1 cm × 7 to 10 cm × 1 mm, bolted at one end into two stacks. Total weight 60.5 grams. |
| Cathode/Anode Distance: | Approximately 5 cm. |
| Stirring: | Paddle in powder, 4 to 5 r.p.m. |
| Timing Cycle: | 60 second cycle as controlled by any conventional micro switch. 50 seconds in forward plating, through the normally closed (N.C.) contact of the timer driven micro switch. 10 seconds in the reverse plating through the normally open (N.O.) contact of the timer driven micro switch. |
| Deposition: | 45 minutes: 1.2 to 0.9 amperes at 3.0 volts forward plating 1.2 to 1.1 amperes in reverse plating.<br>8½ hours: 0.8 amperes in forward plating. 1.0 amperes in reverse plating. |
| Powder Product Work Up: | Rinsed by flooding, mixing, decanting with water three times, with alcohol three times. Vacuum oven drying.<br>Weight 10.51 grams<br>Volume 6.7 ml.<br>App. Den. 1.57 |
| Total Anode Weight Losses: | Copper 4.8 grams<br>Zinc 7.5 grams |

| External | | Normalized* | | By Wt. Loss** |
|---|---|---|---|---|
| Laboratory AAS: | Cu | 36% | 42% | 39% |
| | Zn | 50% | 58% | 61% |

$$*Cu = \frac{36\%}{36\% + 50\%} = 42\% \qquad Zn = \frac{50\%}{36\% + 50\%} = 58\%$$

$$**Cu = \frac{4.8}{4.8 + 7.5} \times 100 \qquad Zn = \frac{7.5}{4.8 + 7.5} \times 100$$

| | |
|---|---|
| Metallographic Examination: | The powder was mounted, ground to cross section, and polished. Some grains did not show an annular or enclading structure. An acidic etchant for copper grain delineation attacked some grains without developing any differentiation or zoning. Some grains showed small areas enclosed by a white envelope. |

Representative of the first product types (Type 2) described earlier in the specification are those multi-metal powders developed according to Process II.

PROCESS II: ANNULAR ELECTRO-DEPOSITION

According to this process the "core" substrate particles have a compact internal condition of higher apparent density than those particles used in Process I. Accordingly, in this Process II method of deposition the second metal deposits at the outside of the particle. Therefore, it does not penetrate into crevices, cracks or other inter-granular voids between non-coherent or dendritic crystals of the base metal. Because this form of electro deposition is conducted upon a base metal powder of initial high apparent density, the resultant powder particles show a substantially laminar structure.

The general circuitry process conditions necessary to generate this high apparent density base metal is described above with respect to Phases I and II, shown schematically in FIGS. 2 and 1, respectively.

Examples 3 and 4 set forth below are representative illustrations of the type 1 products that can be obtained according to the general annular electro-depositions process (Process II). Example 3 shows how a single metal (nickel) can be electro-deposited onto a powder of a different metal (higher apparent density copper), using a combination of both direct and alternating current.

Although the Phase II schematic and attendant apparati may be used to accommodate deposition of the nickel onto a copper powder, the Example 3 operating conditions prefer the incorporation of an A.C. generator into circuit II in lieu of storage battery 30. Similarly, this example prefers a plastic electrolytically cell cylinder within the conical sloped bottom is at approximately a 45° angle. Finally, the Example 3 specifications prefer as anodes two pure nickel sheets suspended in the electrolyte by conventional means, each of which would communicate directly with conductor 26 as shown in FIG. 1. These two pure nickel sheet anodes, of course, would be in lieu of the copper cylinder anode (16) presently shown in FIG. 1.

The specific Example 3 apparati, operating conditions, and resulting deposition analysis are set forth below.

EXAMPLE 3

This example shows the deposition of nickel onto higher apparent density copper, using a combination of direct and alternating current.

| | | |
|---|---|---|
| Apparatus: | Plastic cylinder with 45° sloped bottom. | See general FIG. 1 diagram. |
| Electrolyte Solution: | $NiCl_2 . 6H_2O$ 300 g/l<br>$H_3BO_3$ 30 g/l | volume used, 350 ml |
| Temperature: | 35 - 40° C | |
| Cathode: | Powder, buried or internal contact. | |
| Anode: | Pure nickel sheet, 2 each 2.5 cm × 7.5 cm | |
| Inter-electrode Distance: | Approximately 5 cm, bottoms of anode to top of powder. | |
| Stirring: | Paddle inserted into powder, 4 to 5 revolutions per minute. Additionally manual stirring to powder every 15 to 20 minutes. | |
| Timing Cycle: | 52 second forward direct current (Circuit I) 8 seconds interposed alternating current (Circuit II). Alternative direct and alternating current imposed via conventional microswitch means. | |
| Direct Current: | 0.8 Amperes at 3.0 to 4.5 Volts | |
| Anode Changes: | 1.5 g/2 hour period | |
| Interposed Alternating Current: | 0.5 Amperes at 1.5 Volts | |
| Deposition Times: | Two periods of two hours each, with powder cathode dried and measured at end of each period. | |
| Workup to Dry Powder: | Solution decanted, rinsed 3 times with 5 volumes of water, rinsed 2 times with 5 volumes of alcohol, drained, vacuum oven dried. | |
| Sieving: | The dry powder was screened through a 30 mesh screen, then a 60 mesh screen. A few lightly cemented crusts of +30 mesh were combined with the +60 mesh material and lightly ground in a glass mortar and rescreened. | |

| Sieve Analysis: | | Starting | | 1st 2 Hours | | 2nd 2 Hours | |
|---|---|---|---|---|---|---|---|
| | | Weight | App. Density gm/ml | Weight | App. Density | Weight | App. Density |
| −30 | +60 mesh | 1.08g | 3.38 | 1.18 | 3.37 | 1.91 | 3.2 |
| −60 | +200 mesh | 13.06 | 3.44 | 13.77 | 13.77 | 14.54 | 3.82 |
| −200 | +325 mesh | 3.50 | 3.18 | 3.82 | 3.48 | 3.80 | 3.45 |
| −325 | mesh | 1.05 | 2.63 | 1.23 | 3.01 | 0.97 | 3.00 |
| | Composite: | 18.72 | 3.82 | 19.96 | 4.00 | 21.20 | 4.08 |

-continued

| | | |
|---|---|---|
| Final Composition: Estimated, | $\frac{3.0}{18.7 + 3.0} = \frac{3.0}{21.7} = 14\%$ Ni. | |
| Survey Analysis:* | Copper 74% | Nickel 19% |

*By a commercial laboratory by Atomic Absorptive Spectroscopy.

This example electro-deposition was conducted upon a basis metal powder of initial high apparent density and the resultant powder particles show a laminar structure.

Another example of the Process 2 annular electro-deposition method is illustrated by Examples 4 which involves the deposition of tin onto copper and incorporates the addition of an external water bath 66 as shown in FIG. 4, and an internal cathode cup 50 as shown in FIG. 3.

The electrical circuitry for Example 4 which employs periodic reversed direct current is the same as that shown in FIG. 1.

The electrolytic cell 62 of Example 4 is preferably made of a plastic material such as polyethylene because the particular electrolyte solution 12 is corrosive to glass. Disposed within the electrolyte cell is an internal cathode cup 50 of suitable plastic material. The cathode cup 50 has a copper contact plate 52 disposed at the bottom of said cup on top of a layer of insulating epoxy resin 53. The copper contact plate 52 connects to the external circuitry of FIG. 1 via conventional insulated copper wire 18, the tip 51 of which is soldered to the contact plate 52.

Disposed in the electrolyte solution 12 of Example 4 are a pair of pure tin anodes 64 which are suspended in the solution by means (not shown) and are connected to the external circuitry of FIG. 1 by conducting wire 26.

Surrounding the electrolyte cell 62 is an aluminum pot 61 which provides an outer housing for the external water bath 66. The aluminum pot 61 is separated from the electrolyte cell 62 by conventional insulating means which in the preferred embodiment consist of ceramic blocks 63.

An external heating means 60 provides the temperature control for both the external water bath 66 and the internal electrolyte solution 12. The invention prefers an electric hotplate which may be either manually or servo controlled. Thermometers 65 and 67 are positioned within the external water bath 66 and electrolyte solution 12, respectively, to monitor the temperatures. Phases III and IV also show a conventional motor 42, stirring device 38, and stirring blade 40 to effect movement of high apparent density copper cathode powder which is obtained by Phase II means as described above.

This example which employs tin and copper shows the applicability of the instant invention to the commerce of bronzes by appropriate powder metallurgy methods. The utility of this application is particularly significant in view of the greater cost and scarcity of tin as compared to zinc for brass. Some bronze compositions, for example, have from 5 to 10% tin in copper. The general electro-deposition process which involves the overplating of a second metal onto a high density first metal powder using periodic reversed direct current is substantially the same as the Phase II process described above. The specific operating conditions, electrolyte solution, and resultant powder product analysis are as set forth below.

| | | | |
|---|---|---|---|
| Apparatus: | The plating cell, water jacket, and internal cathode stirring cup are as shown in FIGS. 3 and 4. The electrical circuit and supply are as shown in FIG. 1, Phase II for periodic reverse plating, with a battery cell for each plating direction. | | |
| Electrolyte Solution: | $Sn\,Cl_2 . 2H_2O$ | 150 g/600 ml. | |
| | $N\,H_4\,HF_2$ | 172 g/600 ml. | |
| Temperature: | The plating solution is corrosive to glass. The temperature of the external water bath was held between 59° C and 73° C by manual operation of the heater. | | |
| Cathode: | 40.7 grams of copper powder, apparent density 3.85, volume 10.4 ml was used for the cathode. This powder was made by combining two powders from previous work:<br>19 g of App. Den. 3.44<br>21 g of App. Den. 4.23 (Sieve analysis given at end.) | | |
| Anode: | Pure tin, 2 each 4 × 10 cm. | | |
| Cathode/Anode Distance: | Approximately 4 cm. | | |
| Stirring: | By paddle in powder cathode, 4 to 5 r.p.m. | | |
| Timing Cycle: | 50 seconds forward plating<br>10 seconds reverse plating | | |
| Deposition: | 1½ hours: | Forward plating at 2.4 amperes, 1.2 volts<br>Reverse plating at 2.0 amperes, 0.5 volts | |
| Anode Weight Change: | 6.7 grams. | Some detached material fell to bottom of plating tank, outside of the plating cup. | |
| Powder Product Work Up: | Rinsed by flooding, mixing, decanting with water three times, with alcohol three times. Vacuum oven to dryness. | | |
| Powder: | Weight | 44.9 | grams |
| | Gain | 4.2 | grams |
| | Volume | 14.1 | ml. |
| | App. Density | 3.19 | |
| Composition, Estimated: | $\frac{4.2}{4.2 + 40.7} = 9.4\%$ Tin. | | |
| External Laboratory, AAS: | Sn 9<br>Cu 88 | | |
| Metallographic Examination: | The exterior of each grain is white metal; there are no copper color grains. In cross section | | |

-continued there are no distinct zones or layers. There are some knobs of white metal.
Compared, by etchant, to the grains of the starting powder, a new zone discoloration has appeared.

Cathode Powder:

| Sieve | | Wt/g | Vol/ml | App.Den. | Wt/g | Vol/ml | App.Den. |
|---|---|---|---|---|---|---|---|
| −35 | +60 | 1.26 | 0.48 | 2.62 | 7.30 | 2.20 | 3.32 |
| −60 | +200 | 13.16 | 4.10 | 3.22 | 24.60 | 6.20 | 3.96 |
| −200 | +325 | 3.25 | 1.20 | 2.68 | 2.59 | 0.70 | 3.70 |
| −325 | | 1.52 | 0.62 | 2.44 | 0.21 | 0.80 | 2.60 |
| Composite | | 19.20 | 5.6 | 3.44 | 34.70 | 8.20 | 4.23 |

Final Product:

| Sieve | | Wt/g | Vol/ml | App.Den. |
|---|---|---|---|---|
| | +35 | None | | |
| −35 | +60 | 6.93 | 2.0 | 3.46 |
| −60 | +200 | 32.33 | 10.3 | 3.13 |
| −200 | | 5.69 | 2.0 | 2.84 |
| Composite | | 44.90 | 14.1 | 3.19 |

PROCESS III: REPETITIVE ANNULAR ELECTRO-DEPOSITION

According to Process III which is an extension of Process II, powder metal particles can be prepared which have an overall greater intimacy of the zones of the different metals without resort to direct binary alloy plating.

This method which involves the alternate plating of metal 2 upon metal 1, followed by plating with metal 1, can be used to adjust the overall composition of the alloy. This is particularly useful where the proportion of the second metal has exceeded the desired compositional content. This situation could arise, for example, in a specific sieve size range as a result of in-plating process segregation caused by process variables such as deviations in the agitation rate.

As in the annular electro-deposition of Process II, repetitive annular electro-deposition involves interruptions of the forward plating mode. By interrupting the deposition of the second metal after an initial layer has been deposited and then electro-depositing a layer of the first metal, powder particles are produced in which the diffusion distances and/or diffusion times of the respective metals into each other will be decreased. This is recognized as the second metal and repetitive annular electro-deposition has two directions instead of one in which it is permitted to diffuse.

Example 5 illustrates the type of product that can be obtained according to the repetitive annular electro-deposition method of Process III. This example shows how a basis metal or an internal metal in an integral multi-metal powder particle can be overplated upon the powder, with change in composition. More particularly, in Example 5, copper is electro-deposited onto the powder product obtained above in Example 3. The structure developed by repetitive annular electro-deposition reduces the diffusion time required to attain alloy homogeneity and causes component concentration leveling in the second stage of article fabrication.

Furthermore, the process illustrated by Example 5 alters the resultant powder composition while retaining the non-segregation advantage of a multi-metal integral powder over that of a simple mixture of individual component powders. This method also leads to inventory reduction where a range of alloy compositions is desirable which is a major advantage when one considers the normal problems associated with stocking a foundry warehouse or commercial supply.

As in Example 3, the general electrical circuitry and schematic is as represented in FIG. 1 (Phase II). The particular process parameters of Example 5, however, prefer the substitution of an AC generator into circuit 2 in lieu of the direct current storage battery 30. Additionally, the example prefers a lower electrolyte cell conical slope of 60°. It should be noted that although many of the examples portray an electrolytic cell which has a fixed lower conical portion as described in FIG. 1, such construction is only representative of that which is acceptable to the instant invention. It would be entirely satisfactory, for example, to insert an internal cathode cup such as is shown in FIG. 3 into an electrolytic cell of virtually any configuration. This would permit the insertion of variously sized and sloped cathode cups 50 to accommodate desired operating characteristics.

Example 5 also prefers the incorporation of a conventional microswitch cycle timer (not shown) to permit a regular interruption of the forward plating mode 1. The more specific features of the operating conditions, electrolytic solution, and resultant powder product analysis, are as set forth below.

Example 5

| | |
|---|---|
| Objective: | Develops an example which illustrates the ability of the instant invention to adjust the percentage composition of an integral multi-metal powder. |
| Apparatus: | See Example 3 for the electrical system. Although substantially the same, Example 5 prefers the incorporation of an A.C. generator into circuit II in lieu of the direct current storage battery 30 and the addition of a conventional micro-switch cycle timer to permit a regular interruption of the forward plating mode I. The conical bottom of the electrolyte cell also prefers a slope of approximately 60°. |
| Solution: | $CuSO_4 \cdot 5H_2O$ 142 g/liter<br>$H_2SO_4$ 87 g/liter |
| Temperature: | 35° C. |
| Cathode Powder: | 19.1 grams of product powder as obtained from Example 3. Apparent Density 4.08 |
| Anode: | Sheet copper - 2 each 2 × 3 inches. |

Anode/Cathode Approximately 1 inch.

Example 5-continued

| | | | | | |
|---|---|---|---|---|---|
| Distance: | | | | | |
| Stirring: | 5 r.p.m. | | | | |
| Cycle Timer: | 1 minute cycle: | | 52 seconds normally closed<br>8 seconds normally open | | |
| D.C. Plating: | Through the 52 second normally closed contact | | | | |
| A.C. Interjection: | For the 8 second interval each minute | | | | |
| Plating: | D.C. - 1.8 to 2.0 amperes at 3.8 volts<br>A.C. - 1.0 amperes at 0.9 volts | | | | |
| Plating Time: | 2 hours | | | | |
| Powder Product Work Up: | Rinse three times with water, three times with alcohol. Vacuum oven dry. | | | | |
| Sieve Analysis: | | Mesh | Vol/ml | Wt/g | App. Den. |
| | | −35 | Trace, rejected | | |
| | −35 | +60 | 0.8 | 2.74 | 3.42 |
| | −60 | +200 | 4.50 | 17.68 | 3.95 |
| | −200 | +325 | 0.70 | 2.56 | 3.66 |
| | −325 | | 0.15 | 0.43 | 2.84 |
| | Composite | | 6.00 | 23.41 | 3.90 |
| External Laboratory Analysis: | Cu 86%<br>Ni 13% | | | | |
| | The resultant powder product is pink in color and is attracted to a magnet. | | | | |
| Metallographic Examination: | (1) About 1% of the particles show a silvery coat.<br>(2) About 5 to 10 per cent show in cross section an external pink layer, an intermediate white metal layer and an inner core of pink.<br>(3) The remainder, in cross section, are copper or pink color.<br>The above variations appear to be the result of the interaction of different times of plating with variations in the local thickness of the nickel layer.<br>The final plating solution was analyzed for Nickel by atomic absorption spectroscopy. The external laboratory reported 0.1 grams of nickel per liter of solution. | | | | |

PROCESS IV: DIRECT ALLOY ELECTRO-DEPOSITION

The fourth described process of the general inventive concept disclosed in this application is referred to as direct alloy electro-deposition. According to this process, a direct simultaneous electro-deposition of two different metals may be selected to produce the desired final powder particle products. Obviously, the selected metals are chosen to accommodate a desired final alloy product with particular performance characteristics. A representative example of Process IV is Example 6 which describes the simultaneous deposition of a tin and lead alloy onto a copper metal powder. This example describes a concept of solder coated copper powder particles which would be particularly useful in making various electrical interconnections. The combination of copper, tin and lead is illustrated to show the invention's potential for developing powders useful in producing powder metallurgy leaded brasses and bronzes. The particular choice of metals is representative only and in no way intended to limit the scope of applicant's invention. Numerous other metal combinations could be selected which would incorporate the general concept of applicant's generic process as represented by Processes I, II, III, and IV. The preferred operating condition, electrolytic solution and resultant powder product analysis are set forth in the specification table to Example 6 below.

Example 6

| | |
|---|---|
| Apparatus: | See sketch. The cell is the same as that used in Example 3. Continuous direct current is supplied via circuits I and II of Phase II as shown in FIG. 1. Note that the example prefers an electrolytic cell bottom with conical slope of approximately 45°. |
| Solution: | Fluoborate salts of stannous tin, lead, free fluoboric and boric acid. Peptone added as a grain suppressing agent.<br>$Sn^{++}$ 52 grams per liter<br>$Pb^{++}$ 30 grams per liter<br>$HBF_4$, free 120 grams per liter<br>$H_3BO_3$ 25 grams per liter<br>Peptone 5 grams per liter |
| Room Temperature: | 21° C |
| Cathode: | 29.7 grams of copper powder, apparent density 3.9 |
| Anodes: | 2 each 1" ×2½", 60% Tin, 40% Lead |
| Distance, Anode Bottoms to Cathode: | Approximately 2 inches |
| Stirring: | Continuous at 4 to 5 rpm by a horizontal paddle in the powder plus manual deep overturn at 15 minute intervals, using a plastic spatula (not shown), without turning off the stirring motor. After one hour the top and bottom strata were separated and interchanged. |
| Current: | Continuous direct current of 1.0 Amperes at 2.8 to 3.0 Volts |
| Duration: | Two periods of one hour each, with a 20 minute interruption between to interchange the top and bottom strata. |

Example 6-continued

| | | | | | | | |
|---|---|---|---|---|---|---|---|
| Powder Product Work-Up: | | Decanted solution, rinsed three times with water, rinsed three times with alcohol, vacuum oven dried. | | | | | |
| Sieve Analysis: | | Starting Powder | | | Final Powder | | |
| Mesh | | Grams | Vol/ml | App. Density | Grams | Vol/ml | App. Density |
| | +30 | | None | | .09 | Crusts, | rejected |
| −30 | +60 | 2.81 | 0.8 | 3.52 | 6.82 | 1.90 | 3.60 |
| −60 | +200 | 24.52 | 6.6 | 3.74 | 27.03 | 6.80 | 3.96 |
| −200 | +325 | 1.93 | 0.6 | 3.2 | 1.73 | 0.50 | 3.46 |
| −325 | | 0.43 | 0.2 | 2.1 | 0.39 | 0.12 | 3.24 |
| Composite: | | 29.7 | 7.7 | 3.90 | 35.97 | 8.80 | 4.07 |
| Differential Apparent Density: | | $\frac{\Delta Vol}{\Delta Wt.} = \frac{1.10\ ml}{6.28\ gm} = 5.70$ | | | | | |
| Witnessing Assay: By AAS in Commercial Lab | | cu 71% Sn 10% Pb 18% | | | | | |

In addition to the foregoing examples which have been selected as representative working embodiments of Processes I, II, III, and IV, applicant has developed further multi-metal examples which may be adapted and used according to a plurality of the described processes. These examples, depending upon the relative apparent density of the base metal, may develop either a Type I or a Type II product. Furthermore, depending upon the particular selection of operating condition and/or choice of metals, these specific examples may illustrate several of the described processes. For example, if a relatively high apparent density base metal is selected, the deposited metal and/or metals may be directed plated so as to develop an annular laminar type structure representing a Type II product. On the other hand, if a relatively low density base metal is chosen a Type II product can be obtained by simultaneously electrically densifying the first metal with alternate plating and deplating in a salt solution of a second and/or third metals.

It can also be seen that depending upon the particular base metal, the particular manner in which the deposited metal and/or metals are applied and the choice of designed parameters, the same basic example can be made to follow either a repetitive annular deposition or a direct alloy electro-deposition. Therefore, notwithstanding the fact that the four described representative processes are individually unique and distinctive of product, they are encompassed within the same general concept enbraced in scope by applicant's generic invention.

In Example 7, the concept of plating onto a metal powder has been extended to the plating of copper onto a commercially available iron powder to yield an integral binary metal powder product. The combination of copper and iron is used in the powder metallurgy production of such end product uses as automobile gears. In this context, the copper content can range from 2 to 30%.

An integral binary metal powder as produced in this example will have advantages in the production process over a conventional side by side powder mixture of the same two metals. This is the consequence of more intimate contact, a greater contact area, more uniform particle distribution, reduced aggregation and reduced oxidation of the powder, the latter factor of which is due to the protective outer copper coating.

The plating of Example 7 was conducted in three separate steps, with attendant powder examination and sample retention at the end of each step. In the first step (Part 1 below), a low copper concentration cyanide strike bath was used at room temperature for the first deposition upon the iron powder. The cell parameters set forth below were employed in an electrical schematic substantially as shown in FIG. 1 (Phase II). Iron is electrochemically more active than copper, hence an initial strike is required. Next (Part 2 below) a higher copper concentration cyanide bath was prepared and heated by any conventional means to the described operating level. The bath was then used briefly to establish an operating temperature level for plating while the solution cooled, again employing the basic circuitry of FIG. 1 (Phase II) above. A warm water jacket was then provided (Part 3 below) and the plating continued, this time employing the electrical schematic and attendant apparati of FIG. 4.

The basic description of the FIG. 4 water bath electrolyte cell and related apparati has been presented above in reference to Example 4 which employed the cell structure with other described electrical circuitry. Accordingly, the description of the electrical schematic shown in FIG. 4 is presented here as this schematic is used in conjunction with the Part 3 copper deposition.

FIG. 4 shows an electrical circuit having a storage battery 70, the positive side of which is connected through knife switch 71 and conventional conductor 26 to anodes 64, respectively. The negative side of storage battery 70 communicates via conventional copper conductor 18 with a conventional ammeter 72 and an adjustable resistor 73 to the copper contact plate 52. Inserted in parallel with storage battery 70 is a conventional voltmeter 74. Accordingly, when knife switch 71 is closed current flows from the positive side of storage battery 70 to the anodes 64 (copper in this example) and ultimately returns via conductor 18 from the cathodic contact plate 52. Electric hotplate 60 is manually or servo adjusted to accommodate the desired electrolyte solution temperature, which in this example for Part 3 is 60° C.

In commercial practice only two plating steps would be used. The initial strike in a less concentrated cyanide solution followed by a second strike in the higher cyanide solution concentration, however, results in a higher efficiency bath at the elevated temperature. As both baths are alkaline cyanide, a wet transfer to the second bath does not involve the same hazard as it would if one of the baths were acidic. It is known and observed that copper cyanide baths plate at twice the rate of acid copper baths for the same current.

The specific operating conditions, electrolytic solutions, and design parameters for the three-part plating of copper onto iron are set forth below in the specification table to Example 7.

Example 7

| | | | | |
|---|---|---|---|---|
| Apparatus: | See FIG. 1 (Phase II) for Parts 1 and 2. See FIGS. 3 and 4 for Part 3. | | | |
| Solutions: | | 1st Strike (Used in Part 1) | 2nd Solution (Used in Parts 2 & 3) | |
| | Cu CN | 26 grams | 45 grams | |
| | Na CN | 44 grams | 68 grams | |
| | KOH | 5 grams | 10 grams | |
| | Rochelle Salt | None | 60 grams | |
| | De ionized Water | to 1 liter | to 1 liter | |
| Cathode: | Part 1 | | | |
| | Cenco Iron Metal Technical Powder 11.0 ml, 31.2 g, Apparent Density 2.84 | | | |
| | Sieve Size | Vol/ml | Wt/g | App. Density |
| | +35 | 0 | 0 | |
| | −35 +60 | 0.8 | 2.36 | 2.96 |
| | −60 +200 | 7.8 | 22.13 | 2.84 |
| | −200 | 2.7 | 6.35 | 2.35 |
| | Part 2 | | | |
| | 25 grams of powder from Part 1. | | | |
| | Part 3 | | | |
| | 25 grams of powder from Part 2. | | | |
| Anodes: | Copper sheet, 3 mm, approximately 150 grams. | | | |
| Anode Weight Change: | Part 1 - 1.0 grams | | | |
| | Part 2 - 8.0 grams | | | |
| | Part 3 - 4.5 grams | | | |
| Stirring: | Paddle into cathode powder, 4–5 r.p.m. | | | |
| Current: | Direct current from storage battery cells. | | | |
| Depositions: | Part 1 | | | |
| | 1.2 Amperes | 4.6 volts | 49° C | 1.5 hours |
| | 1.5 " | 5.7 " | 42° C | 2.5 " |
| Depositions: | Part 2 | | | |
| | 2.4 Amperes | 4.6 volts | 53° C | 0.25 hours |
| | 2.4 " | 5.0 " | 43° C | 1.0 " |
| | 2.2 " | 6.0 " | 30° C | 1.25 " |
| | Part 3 | | | |
| | 2.0 Amperes | 4.1 volts | 60° C | 1.0 hour |
| Powder Work Up: | Rinse by flood, stir and decant: water 3 times, alcohol 3 times. Vacuum oven to dryness. | | | |
| Powders Obtained: | | +35 Mesh | Vol/ml | Wt/g | App. Den. |
| | Part 1 | None | 9.8 | 30.8 | 3.17 |
| | Part 2 | None | 10.2 | 31.7 | 3.10 |
| | Part 3 | None | 9.5 | 29.0 | 3.04 |
| Metallographic Examination: | Mounted, ground, and polished. In all cases the iron is bright, compact, and very irregular. The copper is bright and adherent to the iron. The thinnest copper is in Part 1, whereas the thickest is in Part 3. | | | |
| External Laboratory by AAS: | | Cu | Fe | |
| | Part 1 | 18 | 74 | |
| | Part 2 | 35 | 58 | |
| | Part 3 | 45 | 41 | |

As an extension of Example 7, the copper-iron powder metal product developed therein is used as the base powder for the deposition of nickel thereon according to Example 8 below. In Example 8 the basic water bath and electrical schematic as shown in FIGS. 3 and 4 is employed, with continuous direct current to effect the nickel deposition. Accordingly, a three metal (iron, copper, and nickel) integral composite powder product is obtained which is useful in the powder metallurgy production of magnetic products.* This Example 8 powder product is illustrative of the versatility and usefulness of applicant's invention.

*Metals Handbook — 1948, American Society for Metals, Pg 598, Permanent Magnet Materials, includes CUNIFE, 60 Copper, 20 Nickel, 20 Iron.

Example 8

| | |
|---|---|
| Apparatus: | See FIGS. 3 and 4 for general electrical circuitry. |
| Solution: | $NiCl_2$ $6H_2O$ 300 g/liter<br>$H_3BO_3$ 30 g/liter |
| Cathode: | 25 grams of final product of Example 7. |
| Anodes: | Pure sheet nickel, 2 each, 1 inch × 3 inches |
| Anode Weight Change: | 5.6 grams |
| Stirring: | Paddle into cathode powder, 4 to 5 rpm. |
| Current: | Direct current from storage battery cells, continuous. |
| Deposition: | 2.6 amperes at 3.6 to 3.9 volts for 1.5 hours |
| Temperature: | 60° to 66° C. |
| Powder Product Work Up: | Rinsed by flooding, stirring, decanting, three times with water, three times with alcohol, vacuum oven dried. |
| Powder: | 5% +35 mesh<br>Weight, 30.3 grams |

Example 8-continued

| | |
|---|---|
| | Volume, 8.7 ml |
| | Apparent Density, 3.48 |
| External Laboratory Examination of Powder by Atomic Absorption Spectroscoposy: | |
| | Copper 32 |
| | Iron 41 |
| | Nickel 21 |

The concept of plating a metal onto an integral composite metal powder is further extended in Example 9 to plating chromium onto the powder product obtained above in Example 8. An integral powder of iron, copper, nickel, and chromium has tremendous application in the powder metallurgy production of articles approaching stainless steels* in composition. The powder obtained here, which is representative of applicant's invention is in no way intended to limit the scope of possible metal combinations and/or applications.

*17-4 pH Stainless contains Chrome, Nickel, Copper and Iron as major constituents.

Figure 5:
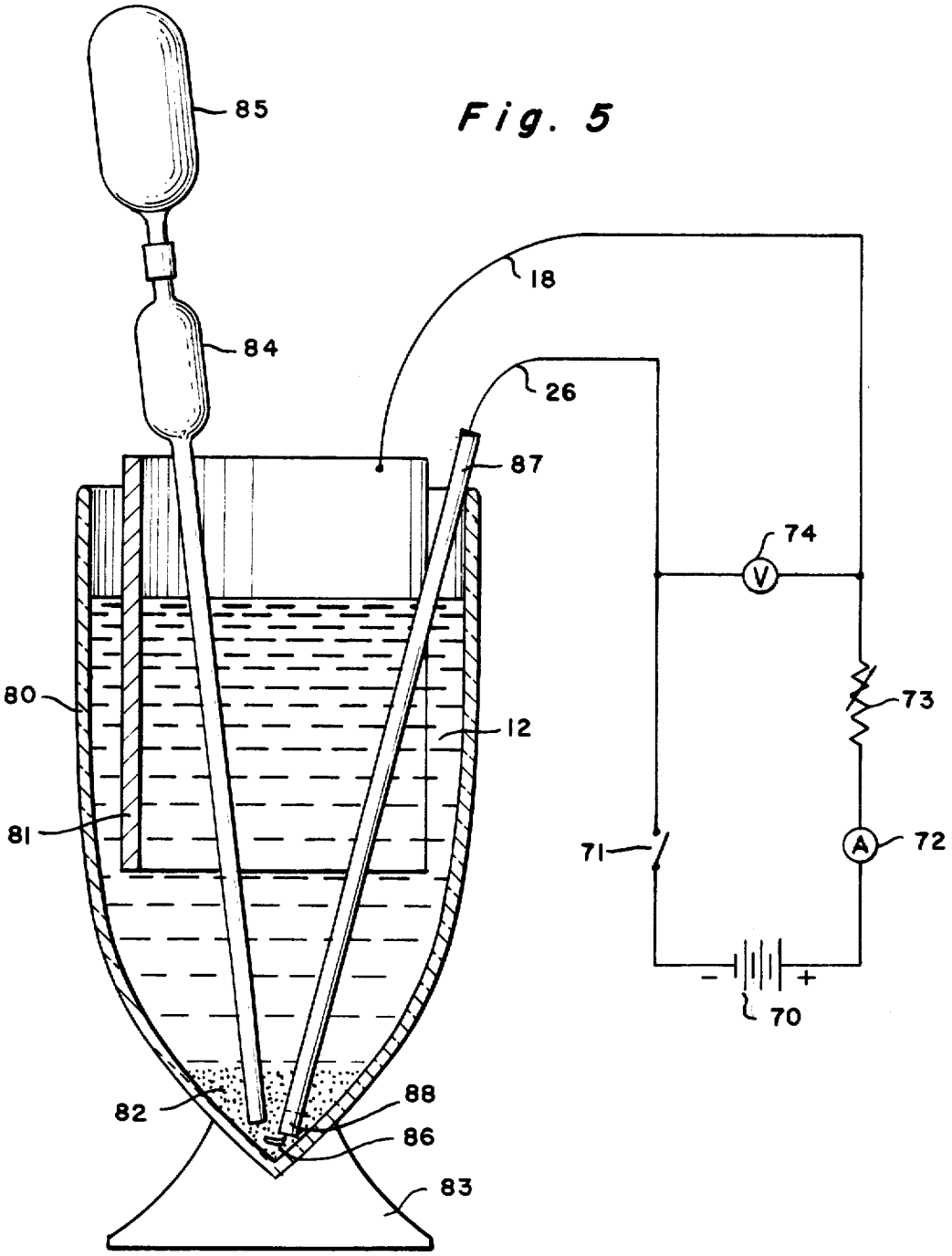
FIG. 5 shows schematically and in partial cross-section a view of an assembly to include the overall electrical circuitry used in connection with the final phase of Example 9 wherein chromium is deposited onto the powder metal particle product from Example 8.

FIG. 5 shows the electrolytic cell and associated electrical schematic used in conjunction with the deposition of chromium onto the three-metal powder composite product of Example 8 as specifically described below in Example 9.

In FIG. 5 the electrolyte solution 12 is shown contained in a laboratory scale 8 ounce glass cell 80 which is seated upon pedestal mount 83. Suspended in the solution 12 by conventional mounting means (not shown) is a curved sheet lead anode 81 approximately 4 inches in height and 8 inches in dimensional curvature. The relative size and/or number of anode plates may, of course, be varied to accommodate the particular cell and electrolytic solution characteristics. Disposed at the bottom of glass cell 80 is approximately 25 grams of the multi-metal cathodic powder product 82 of Example 8.

Extending into cathodic powder product 82 is an inverted 25 ml pipette 84 which, together with syringe 85, serves as suitable apparatus to agitate the powder product 82. This agitation is accomplished at approximately 5 to 10 minute intervals by syringing 25 ml of fluid into and out of the pipette.

The associated electrical circuit of FIG. 5 is identical to that described and shown in FIG. 4 as used in Example 7, except that in FIG. 5 storage battery direction is reversed. Accordingly, current flows from storage battery 70 through ammeter 72 and conductor 18 to anode 81. The circuit completes itself through solution 12 and current returns via copper contact 86 and contiguous conducting wire 26 when knife switch 71 is closed. Note that conductor 26 is enclosed in glass tubing 87 during its traversal through solution 12 into the cathodic powder product 82. The glass tubing 87 is sealed at the bottom by internal seal 88.

During the direct current plating mode, the chromium for solution 12 deposits itself upon the powder product 82.

The more specific design parameters and resultant composite product analysis are set forth in the specification table to Example 9 below.

Example 9

| | |
|---|---|
| Apparatus: | See FIG. 5 |
| Solution: | $CrO_3$ 248 g/liter<br>$H_2SO_4$ 2.48 g/liter |
| Cathode: | 25 grams of powder product of Example 8. |
| Anode: | Sheet lead 4 inches × 8 inches. |
| Stirring: | By syringing 25 ml of fluid back and forth agitating the powder. Manual at 5 to 10 minute intervals. |
| Current: | Direct current from two storage battery cells, continuous. |
| Deposition: | At 1.0 to 0.3 amperes, for 1 hour, 50 minutes |
| Temperature: | 31° to 33° C. |
| Powder: | After extensive rinsing with water, rinsed with alcohol and then vacuum oven dried. 95% through 35 mesh Volume, 7.3 ml Weight, 24.3 grams Apparent Density, 3.33 Metallographically there was no visual distinction between the mounted and polished cross sections of the powders from Examples 8 and 9. |
| Exterior Laboratory by AAS: | Cu 32 Fe 13<br>Ni 39 Cr 0.1 |

The final Example illustrates the deposition of iron onto copper. In Example 10 the concept of plating a metal onto a powder of a different metal is extended to show that a pair of metals can be reversed with respect to base metal and deposited on metal, respectively. This example is the reverse of Example 7 above. The selection of copper, instead of iron, for the core can be made where copper is desired as the higher percentage metal in the final composite. In this general composite formulation an easier fabrication could be possible. This Example also serves to emphasize the novelty, flexibility, and utility of the general inventive concept herein described and claimed. Furthermore, the method of Example 10 is of extreme usefulness where commercially available iron powder of prerequisite properties is not readily obtainable. A further area of potential commercial application exists with respect to the providing, either iron alone or in conjunction with a second metal, perhaps nickel, powders with thin magnetic films and coatings. In this respect, the plating of iron onto copper powder is of importance equal to that presented in Example 3, wherein nickel is deposited onto a higher apparent density powder. Indeed, a magnetic powder is obtained therein without the need for grinding.

The plating of iron onto copper powder according to Example 10 employs two preliminary and preparatory platings to qualify the third and final deposition. In the first preparatory plating step, iron was plated onto an iron rod, using the plating solution given in Example 10, to establish the solutions adequacy to plate iron onto iron. In the second preparatory step, a copper rod was exchanged for the iron rod cathode and iron was plated onto this copper rod, to establish that iron could be plated from this same solution onto copper. Finally, in the third step, copper powder was exchanged for the copper rod, and iron was deposited onto the copper powder according to the specification table and process conditions set forth below for Example 10.

Example 10

| | |
|---|---|
| Apparatus: | The plating cell with 60° cone is the same as that used and described in Example 1 (Phase II). The electrical supply and circuitry is the same as that used and described in Example 6. |
| Electrolytic Solution: | $Fe\ SO_4 . 7\ H_2O$ 240 g/liter<br>$H_2\ SO_4$ to adjust pH<br>pH 2.5 to 2.9<br>In use, an insoluble iron turbidity appears at pH 3.0 and above. This is filtered off and the filtrate adjusted to pH 2.5 140 2.9 with dilute sulfuric acid. |
| Temperature: | 30° C to 35° C. |
| Cathode: | 14.0 grams of a copper powder with the following analysis: |

| Sieve | Fract. | Vol/ml | Wt/ml | App. Den. |
|---|---|---|---|---|
| −35 | +60 | 1.20 | 3.75 | 3.12 |
| −60 | +200 | 7.10 | 26.42 | 3.72 |
| −200 | +325 | 2.10 | 6.68 | 3.18 |
| −325 | | 2.50 | 5.28 | 2.10 |
| Composite | | 11.40 | 42.13 | 3.82 |

| | |
|---|---|
| Anode: | Two pieces of angle iron, 2.5 × 2.5 × 10 cm. |
| Cathode/Anode Distance: | Approximately 4 cm. |
| Stirring: | By paddle inserted into powder in the 60° cone, rotating at 4 to 5 rpm. |
| Current: | Continuous direct current supplied by storage battery cells, through a variable resistor as in Example 6. |
| Deposition: | 1-1/2 hours at 160 milliamperes at 1.4 volts. Interruption to rinse and dry powder for examination. 3 hours at 170 milliamperes at 1.8 volts. On resumption, with 2 cells (4 volts) only 2 milliamperes flowed. The plating cell is then subjected to alternating current, 60 cycle, by substituting a conventional variable transformer for the storage battery. 2 amperes of A.C. is passed through the cell for approximately 5 seconds. This activates the surface so that instead of 2 milliamperes of plating current, 170 milliamperes of plating current is passed through the electrolytic solution. This results in a 170/2 or 85 fold increase in the deposition rate. The storage battery is then reconnected and plating resumed at 170 milliamperes. |
| Powder Product Work Up: | The powder is then rinsed by flooding, stirring, and decanting with water 3 times, and with alcohol 3 times. The product is then vacuum oven dried. |
| Sieve Analaysis: | |

| Mesh | | Vol/ml | Wt/g | App. Den. |
|---|---|---|---|---|
| −35 | + +60 | 0.30 | 0.84 | 2.80 |
| −60 | +200 | 2.50 | 8.93 | 3.58 |
| −200 | +325 | 0.90 | 2.23 | 2.50 |
| −325 | | 0.60 | 1.34 | 2.24 |
| Composite: | | 3.80 | 13.35 | 3.58 |

| | |
|---|---|
| External Laboratory AAS: | Cu 92%<br>Fe 3.2% |
| Metallographic Examination: | (Mounted and cross sectioned.)<br>White metal is most apparent as an envelope around the smaller grains. With an acidic etchant the white metal margins vanished. |

The 10 examples described above showing the diverse applications of this invention are summarized in the following Table I.

Table I:

Summary of Examples

I. Nickel onto Low Density - Copper
Stage 1. Produce low density copper
Stage 2. Overplate with nickel
Analysis: Copper 30%
Nickel 60%

II. Zinc onto Low Density Copper in Two Stages (Parallel to I.)
Analysis: Copper 40%
Zinc 60%

Table I:-continued

Summary of Examples

III. Nickel onto Higher Apparent Density Copper
Analysis: Copper 74%
Nickel 19%

IV. Tin onto Copper (Parallel to III)
Analysis: Copper 88%
Tin 9%

V. Copper on Product from III.
Analysis: Copper 86%
Nickel 13%

VI. Simultaneously Plate Tin and Lead onto Copper Powder (Plate an alloy onto a metal)
Analysis: Copper 71%
Tin 10%
Lead 18%

VII. Plate Copper onto Iron Powder in Three Steps of Plating

| | 1. | 2. | 3. |
|---|---|---|---|
| Analysis: Copper | 18% | 35% | 45% |
| Iron | 74% | 58% | 51% |

VIII. Nickel onto Product from VII. (Three metals)
Analysis: Copper 32%
Iron 41%

Table I:-continued

| Summary of Examples | | |
|---|---|---|
| | Nickel 21% | |
| IX. Chromium onto Product from VIII. (Four metals) | | |
| Analysis: | Copper 32% | Nickel 39% |
| | Iron 13% | Chrome 0.1% |
| X. Plate Iron onto Copper (Reverse of VII) | | |
| Analysis: | Copper 92% | |
| | Iron 3% | |

The foregoing examples and cell designs illustrate some of the process techniques and possible applications for integration of alloy components into individual powder metallurgy powder particles. Many advantages arise out of the production of such alloy powders. For example, one field of use is in the production of automobile gears.

An integral binary and/or multi-metal powder as produced by this invention has many advantages over conventional side by side powder mixtures of the same metals. The multi-metal products of this invention provide more intimate contact between metals, greater contact area, more uniform distribution, reduced segregation and reduced oxidation of the powder.

A further application of this invention resides in the plating of chromium onto the powder products of iron, copper, and nickel where this technique provides articles of stainless steel compositions. Another potential commercial application is that of providing, with either iron alone or a second metal such as nickel, powders with thin magnetic coatings or films.

Additional advantages and modifications will readily occur to those skilled in the art. The invention in its broader aspects is therefore not limited to the specific details, representative processes, and illustrative examples shown and described. Accordingly departures may be made from such details without departing from the spirit or scope of applicant's general inventive concept.

I claim:

1. A method of producing a diffuse composition of multi-metal particles comprising the steps of:

a. providing a cathode comprising a powder of at least a first metal, said powder having a relatively low apparent density of less than approximately 22% of the maximum theoretical density of said first metal;

b. electro-depositing a second metal onto said cathode from an electrolytic composition containing ions of said second metal by imposing direct electrical current on the electrolytic composition;

c. periodically interrupting the flow of direct electrical current, the period of direct current flow being of greater ampere second duration than the period of interruption, wherein 1. deplating of both the first and second metals is effected during each period of interruption,
2. comingling in solution of ions of both the first and second metals is effected by said deplating, and
3. codepositing of both the first and second metals together in a comingled state is effected by each period of direct current flow following a period of interruption;

d. continuing the electro-deposition of said second metal until a desired substantially homogeneous multi-metal composition is obtained.

2. A method according to claim 1 in which the direct current is interrupted by periods during which reverse direct current is imposed on the electrolytic composition.

3. A method according to claim 1 in which the direct current is interrupted by periods during which alternating current is imposed on the electrolytic composition.

4. A method according to claim 1 wherein the cathode is selected from a group of metals comprised of iron, nickel, copper, tin, zinc, lead, gold, silver, platinum, irridium, rhodium, ruthenium, cobalt, indium, manganese, antimony, cadmium and combinations thereof.

5. A method according to claim 1 wherein the electrolytic composition contains metal ions from a group of metals comprised of iron, nickel, copper, tin, zinc, lead, chromium, gold, silver, platinum, irridium, rhodium, ruthenium, cobalt, indium, manganese, antimony, cadmium and combinations thereof.

6. A method according to claim 2 in which the cathode is low apparent density copper and the second metal is nickel.

7. A method according to claim 3 in which the cathode is low apparent density copper and the second metal is nickel.

8. A method according to claim 2 in which the cathode is low apparent density copper and the second metal is zinc.

9. A method according to claim 3 in which the cathode is low apparent density copper and the second metal is zinc.

10. A method of producing a unitary composition of multi-metal particles comprising the steps of:

a. providing a cathode comprising a powder of at least a first metal;

b. electro-depositing a second metal onto said cathode from an electrolytic composition containing ions of said second metal by imposing direct electrical current on the electrolytic solution;

c. periodically interrupting the flow of direct electrical current, the period of direct current flow being of greater ampere seconds duration than the period of interruption, wherein:

1. deplating of ions of the first metal is effected during each period of interruption,
2. comingling in solution of ions of both the first and second metals is effected by said deplating, and
3. codepositing of ions of both the first and second metals is effected by each period of direct current flow following a period of interruption; and d. continuing the electro-deposition until a desired multi-metal composition is obtained.

11. A method according to claim 10 in which the direct current is interrupted by periods during which reverse direct current is imposed on the electrolytic composition.

12. A method according to claim 10 in which the direct current is interrupted by periods during which alternating current is imposed on the electrolytic composition.

13. A method according to claim 10 wherein the cathode is a powder selected from a group of metals comprised of iron, nickel, copper, tin, zinc, lead, gold, silver, platinum, irridium, rhodium, ruthenium, cobalt, indium, manganese, antimony, cadmium and combinations thereof.

14. A method according to claim 10 wherein the electrolytic composition contains metal ions from a group of metals comprised of iron, nickel, copper, tin, zinc, lead, chromium, gold, silver, platinum, irridium, rhodium, ruthenium, cobalt, indium, manganese, antimony, cadmium and combinations thereof.

15. A method of producing a unitary composition of multi-metal particles comprising the steps of:

a. providing a cathode comprising a powder of at least a first metal;

b. electro-depositing an alloy onto said cathode from an electrolytic composition containing ions of a plurality of metals by imposing direct electrical current on the electrolytic composition;

c. periodically interrupting the flow of direct electrical current, the period of direct current flow being of greater ampere seconds duration than the period of interruption, wherein:

1. deplating of ions of the first metal and of all metals comprising said alloy is effected during each period of interruption, 2. comingling in solution of ions of the first metal and all metals comprising said alloy is effected during said deplating, and 3. codepositing of the first metal and all metals comprising said alloy is effected during each period of direct current flow following the period of interruption; and d. continuing the electro-deposition until a desired multi-metal composition is obtained.

16. A method according to claim 15 wherein the cathode is selected from a group of metals comprised of iron, nickel, copper, tin, zinc, gold, silver, platinum, irridium, rhodium, ruthenium, cobalt, indium, manganese, antimony, cadmium and combinations thereof.

17. A method according to claim 15 wherein the first and second electrolytic compositions contain metal ions from a group of metals comprised of iron, nickel, copper, tin, zinc, lead, chromium, gold, silver, platinum, irridium, rhodium, ruthenium, cobalt, indium, manganese, antimony, cadmium and combinations thereof.

18. A method according to claim 15 in which the direct current is interrupted by periods during which reverse direct current is imposed on the electrolytic composition.

19. A method according to claim 15 in which the direct current is interrupted by periods during which alternating current is imposed on the electrolytic composition.

20. A method according to claim 15 wherein the electrolytic composition contains metal ions from a group of metals comprised of iron, nickel, copper, tin, zinc, lead, chromium and combinations thereof.

21. A method of producing a unitary composition of multi-metal particles comprising the steps of:

a. providing a cathode comprising a powder of at least a first metal, said powder having a relatively low apparent density of less than approximately 22% of the maximum theoretical density of said first metal;

b. electro-depositing an alloy onto said cathode from an electrolytic composition containing ions of a plurality of metals by imposing direct electrical current on the electrolytic composition;

c. periodically interrupting the flow of direct electrical current, the period of direct current flow being of greater ampere seconds duration than the period of interruption, wherein said periodic interruption of the flow of direct electrical current results in the following:

1. deplating of the first metal and all metals comprising said alloy during each period of interruption, 2. comingling in solution of ions of the first metal and all metals comprising said alloy during said deplating, and 3. codepositing of the first metal and all metals comprising said alloy together in a comingled state during each period of direct current flow following a period of interruption; and d. continuing the electrodeposition of said alloy until a desired multi-metal composition is obtained.

22. A method according to claim 21 in which the direct current is interrupted by periods during which reverse direct current is imposed on the electrolytic composition.

23. A method according to claim 21 wherein the cathode is a powder selected from a group of metals comprised of iron, nickel, copper, tin, zinc, lead, gold, silver, platinum, irridium, rhodium, ruthenium, cobalt, indium, manganese, antimony, cadmium and combinations thereof.

24. A method according to claim 21 wherein the electrolytic composition is selected from a group of metals comprised of iron, nickel, copper, tin, zinc, lead, chromium, gold, silver, platinum, irridium, rhodium, ruthenium, cobalt, indium, manganese, antimony, cadmium and combinations thereof.

* * * * *